US006855425B2

(12) United States Patent
Lancaster

(10) Patent No.: US 6,855,425 B2
(45) Date of Patent: Feb. 15, 2005

(54) POLYMER FILAMENTS HAVING PROFILED CROSS-SECTION

(75) Inventor: Peter Michael Lancaster, Gloucestershire (GB)

(73) Assignee: Invista North America S.A.R.L., Wilmington, DE (US)

( * ) Notice: Subject to any disclaimer, the term of this patent is extended or adjusted under 35 U.S.C. 154(b) by 0 days.

(21) Appl. No.: 10/333,187

(22) PCT Filed: Jul. 5, 2001

(86) PCT No.: PCT/US01/21251

§ 371 (c)(1),
(2), (4) Date: Jan. 16, 2003

(87) PCT Pub. No.: WO02/04720

PCT Pub. Date: Jan. 17, 2002

(65) Prior Publication Data

US 2003/0209002 A1 Nov. 13, 2003

(30) Foreign Application Priority Data

Jul. 10, 2000 (GB) ..... 0016926

(51) Int. Cl.[7] ..... D01F 6/00
(52) U.S. Cl. ..... 428/397; 428/398; 428/376
(58) Field of Search ..... 428/376, 398, 428/397, 399

(56) References Cited

U.S. PATENT DOCUMENTS

| | | | |
|---|---|---|---|
| 3,528,128 | A | 9/1970 | Murakami et al. |
| 4,176,211 | A | 11/1979 | Jackson |
| 4,364,996 | A | 12/1982 | Sugiyama |
| 5,141,811 | A | 8/1992 | Kawakami et al. |
| 5,149,517 | A | 9/1992 | Fain et al. |
| 5,604,036 | A | 2/1997 | Price et al. |
| 5,834,119 | A | 11/1998 | Roop |

FOREIGN PATENT DOCUMENTS

| | | |
|---|---|---|
| EP | 0 769 578 | 4/1996 |
| GB | 985 295 | 3/1965 |
| GB | 143 2285 | 8/1974 |
| JP | 61083316 | 4/1986 |
| JP | 10-52839a | 2/1989 |
| JP | 10 212621 | 8/1998 |
| JP | 1-20243/89 B | 11/1998 |

*Primary Examiner*—N. Edwards
(74) *Attorney, Agent, or Firm*—Connolly Bove Lodge & Hutz LLP; Myron K. Wyche

(57) ABSTRACT

The invention provides a profiled polymer filament having an open hollow cross-sectional shape normal to the longitudinal axis of the filament, wherein the cross-section is dimensioned to prevent the filament from interlocking with a second filament of the same cross-section. The invention also provides methods of manufacture of such filaments by melt spinning a polyamide, and spinnerets suitable for use in melt spinning such filaments.

10 Claims, 4 Drawing Sheets

POLYMER FILAMENTS HAVING PROFILED CROSS-SECTION

FIELD OF THE INVENTION

This invention relates to synthetic polymer filaments with an "open hollow" profiled cross section normal to the longitudinal axis of the filament. The invention further relates to spinneret plates for melt extrusion of the filaments, and to methods of manufacture of the-filaments by melt extrusion.

BACKGROUND

Textile fibres or filaments from synthetic polymers, particularly polyamide polymers like nylon 66 and nylon 6, and multifilament yarns melt extruded from the same polyamide polymers, are produced for apparel uses typically as partially oriented yarn (POY) and drawn yarn. POY will have an elongation to break greater than about 55% and drawn yarn will have a lower elongation. Circular is the most common cross sectional shape for each filament comprising the multifilament yarns of either type, e.g. POY and drawn yarn. Variation on the individual filament cross sectional shapes include trilobed or 6-lobed, disclosed in Japanese Kokoku patent document 01-20243 (Nihon Ester KK), the scalloped oval cross section as disclosed by in U.S. Pat. No. 5,834,119 (Roop) and hollow polyamide filaments with a single longitudinal void, disclosed in U.S. Pat. No. 5,604,036 (Bennett et al.).

All of the foregoing examples are known variants of profiled cross sectional shaped POY and drawn yarn. Filaments with cross sectional shapes other than circular provide multifilament yarns for fabrics and garments with varied visual aesthetics, opacity and cover and lighter weight. Yarns from hollow filaments, for example the yarns of the last mentioned United States patent; provide lighter weight fabrics and garments and enhanced heat retentive properties versus conventional circular filaments, without a longitudinal void. Hollow filament yarns are particularly suited for apparel applications when textured by the conventional processes, e.g. air jet texturing (AJT) and false twist texturizing (FTT) to obtain bulky yarns. Hollow flat yarns for direct use in weaving applications are also known.

Both partially oriented and flat nylon yarns in a high void volume hollow are disclosed by Bennett et al. However, filaments with longitudinal voids are difficult to close perfectly at spinning, and may also deform substantially during the texturing process. This may result in a letter 'C-shaped' filaments and/or collapsed tube cross sectional shapes. Letter C-shaped filaments are able to pack closely together with a loss of open space among neighbouring filaments. In addition, letter C-shaped cross sectional filaments and collapsed tube cross sections lead to undesirable yarn and fabric properties as a result of such occurrences. Increased fabric density and diminished heat retention of the fabric and garments are among the undesirable properties. Furthermore, yarns from filaments with varied amounts of ruptured longitudinal voids contribute to dyed fabric streakiness and the intact filament voids provide opportunistic bacteria with a place to flourish.

It has now been found that the above-enumerated disadvantages can be overcome by the production of polymer filaments having a novel cross-section.

The present invention provides a profiled filament from synthetic polymer having an "open hollow" cross-sectional shape normal to the longitudinal axis of the filament. The cross-section is dimensioned to prevent a first filament from interlocking with a second filament having the same cross-section. This means a region proximate to each tip of the cross-section is wider than a spacing between said regions defining an opening to the open hollow cross-section.

The profiled cross sectional shape filaments of the invention are provided by the novel shape and design of the extrusion capillary. The filaments of this invention are prepared directly by melt extrusion of synthetic polymer through a multi-capillary spinneret plate. The term "open hollow" denotes a generally C-shaped or U-shaped cross-section having a hollow center, and a solid region defining wall portion extending around the hollow center to enclose the hollow center, but with an opening in one side of the wall linking the center to the outside of the filament. The opening is narrower than the diameter of the hollow center, thereby forming a throat or constriction between the hollow center and the outside of the filament.

Preferably, the filament comprises a solid part substantially enclosing a central hollow region. An opening leads from the exterior of the filament into the central hollow region. The solid part includes legs that terminate in feet. Confronting surfaces of the feet define the throat (the narrowest dimension) of the opening. The throat of the opening subtends a radial angle alpha ($\alpha$) of not more than 90°, more preferably not more than 75° and most preferably from 10° to 60°. As seen in FIG. 1, the radial angle alpha ($\alpha$) is that angle defined between two rays $R_1$ and $R_2$ originating at a point C. The point C is that point lying on the interior surface of the solid part of the filament that lies farthest from a reference line $R_3$ tangentially connecting the tips of the feet. Each ray $R_1$, $R_2$ extends from the point C and lies tangent to a point on the confronting surfaces of the feet defining the throat of the opening D. The solid part subtends a radial angle equal to 360° minus angle alpha (360°-$\alpha$). Preferably, the solid part of the cross-section subtends a radial angle of at least 270°. More preferably the solid part subtends a radial angle of at least 300°.

The filaments according to the present invention are adapted to prevent inter-engagement or stacking of the filaments. For example, hook-like engagement of two cross sections arising from insertion of an end of the solid part of a first filament cross-section through the opening in the cross-section of a second filament is prevented. This provision can be achieved as already described, by making the solid portion of the cross-section subtend a large radial angle, whereby the opening in the filament cross-section is very small. Alternatively or additionally, the ends of the solid part of the cross section may be enlarged to inhibit insertion into the opening of other filaments.

The solid portion of the cross-section in the filaments according to the present invention may form a single continuous curve. Preferably, the cross-section comprises a "central arcuate" or base portion having first and second ends and two side or "leg" portions. The leg portions extending in substantially side-by-side relationship from the first and second ends of the central arcuate portion.

In preferred embodiments, such as the filament cross section geometry shown in FIG. 1, the filament cross sectional shape is characterized by a central arcuate portion 1 (extending horizontally in FIG. 1) and first and second, generally parallel, elongated leg portions 2, 3 (extending vertically in FIG. 1) joined to the central arcuate portion. The distal portion of each leg (2, 3) opposite the juncture with the central arcuate portion 1 defines an enlarged foot portion 4. Each foot portion 4 is characterized by dimension F, the length of the foot, as shown in FIG. 1. The profiled filament cross-section is open in the center. This open portion is bounded on three sides by the leg portions 2, 3 and central arcuate base portion 1. The feet portions 4 are oriented in a substantially side-by-side relationship defining an aperture between confronting surfaces of the foot portions with dimension D leading to the open portion, as shown in FIG. 1. The dimension D is less than dimension F. As a result, any foot on any leg of the profiled filament is sufficiently large with respect to the aperture between the pair of legs on any other identical filament to prevent a foot of the first filament from being accommodated (interlocked) between the legs of the other filament in a multifilament yarn bundle, as illustrated by FIG. 2.

Preferably, the polymer used to form the profiled polymer filament according to the present invention is a polyamide. More preferably, the polyamide polymer has a relative viscosity, by a formic acid method, greater than 40, and still more preferably the relative viscosity of the polyamide by a formic acid method is in the range of 46 to 56. Preferably, the polyamide is selected from the group consisting of nylon 66 and nylon 6 and copolyamides.

Preferably, the single filament linear density is from 0.5 to 20 dtex, and more preferably it is from 2 to 10 dtex. Most preferably it is less than 4 dtex. Preferably, the filament cross-sectional shape is substantially constant along the length of the filament. Preferably, the filament non-uniformity is less than 1 Uster %.

The profiled filaments according to the present invention provide a lighter unit weight yarn, particularly after texturing by AJT (air jet texturizing) or FTT (false twist texturizing). The yarn incorporates high free volume of air space. The volume of air space contributes to enhanced thermal retention of fabrics and garments produced from the yarn. The yarn when knitted or woven into fabrics provides a less dense fabric than similarly constructed fabrics from solely circular cross section filaments. Furthermore, the yarn exhibits a high moisture wicking capacity.

Accordingly, the present invention further provides a multifilament yarn comprising at least a portion of the profiled filaments according to the present invention.

Preferably, the yarn comprises at least 10% by weight of the profiled filaments according to the present invention, more preferably at least 25% of such filaments, still more preferably at least 50% of such filaments and most preferably it consists essentially of such filaments.

The present invention further provides an article comprising at least a portion of the yarn according to the present invention. Preferably, the article comprises a textile fabric that is knitted or woven from a yarn according to the present invention.

A further aspect of the present invention is a spinneret for the production of the profiled open hollow filaments according to the present invention by melt extrusion of polymer into filaments. The spinneret comprises a plate having upper and lower surfaces connected by an assembly of capillaries. The shape, size and configuration of the capillaries are adapted to the melt spinning of filaments according to the present invention. Specifically, either each capillary comprises two adjacent segments as in FIG. 3*a*, whereby the open hollow filament cross section longitudinal to the axis of the filament is obtained as the molten polymer streams from each segment coalesce at a point between the segments or each capillary has an open hollow transverse cross-section as in FIG. 3*b*.

The preferred spinneret plate for the production of the profiled open hollow filaments is one with each capillary comprised of two segments in FIG. 3*a*. Each segment is comprised of a straight length portion 30 having at each end a junction with a pair of projecting portions. At the first end, the pair of projecting portions are of equal area and each comprise a straight portion 31, 32 terminating in a round portion 33, 34. At the second (opposite the first) end, are a pair of unequal area projecting portions. The first unequal area projecting portion is comprised of straight portion 35 and round portion 36 and the second unequal area projecting portion is comprised of straight portion 37 and round portion 38. Therefore, each segment of the capillary has three equivalent projecting portions, two on one end and one on the opposite end. The unique (longer) projecting portion present on each segment is comprised of straight portion 37 and round portion 38. Preferably, each capillary segment is the mirror image of the other segment. More preferably, each segment is the nonsuperimposable mirror image of the other segment, for example as illustrated by FIG. 3*a*. The nonsuperimposable mirror image relationship means that each segment possesses handiness in the same way as do human left and right hands.

The open hollow filament cross section normal to the longitudinal axis of the filament is obtained as the molten thermoplastic polymer streams from each capillary segment coalesce at a point between projecting portions of the two segments. That is, the open hollow filament cross section of the invention is formed as the molten polymer stream coalesces between confronting round portions 38 of the left and right capillary segments shown in FIG. 3*a*.

In the case where the capillaries themselves have an open hollow cross-section, the capillary illustrated by FIG. 3*b* is a preferred spinneret geometry cross section for the production of profiled open hollow filaments. Each capillary has a cross sectional shape comprising a first straight portion 40 with a first end and a second end, opposite each other. Bifurcating from the first end of the first straight portion 40 are a second straight portion 48 and a third straight portion 50. The second straight portion 48 terminates in a round portion 49 and the third straight portion 50 extends to a point of bifurcation; wherein a fourth straight portion 53 and a fifth straight portion 52 extend from this point of bifurcation. The fourth and fifth straight portions having unequal areas and each terminate in round portions 54 and 51. Similarly, bifurcating from the second end of the first straight portion are a sixth straight portion 41 and a seventh straight portion 43. The sixth straight portion 41 terminates in a round portion 42 and the seventh straight portion 43 extends to a point of bifurcation;

wherein an eighth straight portion 46 and a ninth straight portion 44 extend from said point of bifurcation, the eighth and ninth straight portions having unequal areas and each terminate in round portions 45 and 47.

In a further aspect, the invention provides a process for making drawn yarns and partially oriented yarns (POY) with a modified filament cross section according to the present invention. Generally, the process comprises extruding a polyamide melt, typically nylon 66 or nylon 6, of 40 to 60 RV (measured in formic acid), and preferably 48 to 52 RV to form a plurality of filaments. The spinneret according to the invention is maintained at a temperature selected from the range 245 to 295° C., more preferably it is 280° C. Multiple filaments extruded through the spinneret are cooled in a cross flow of air to form solid filaments. These filaments may be treated with oil, converged, interlaced and drawn, or remain undrawn, prior to winding up a multifilament yarn at a speed greater than 3000 meters per minute (m/min).

Referring now to the process schematic in FIG. 5, a drawn yarn is prepared by following path A. The melted polymer 10, a polyamide, is pumped to the spin pack 20 and forced through spinneret plate 30 to form filaments 40. The emerging filaments are cooled by a cross flow of air 50, having an air velocity of about 0.15 to 0.5 meters per minute. The cooled filaments are converged into a yarn 60, and an oil and water finish is preferably applied to the resulting yarn bundle at 70. The yarn 60 is forwarded through a first air interlace jet 80 to become intermingled yarn 90. Yarn 90 is forwarded to a first godet 92 (the feed roll) and its associated separator roll, wrapping several times to prevent slippage, and then to a second godet 94 (the draw roll) and its associated separator roll. The draw roll 94 is moving at a surface speed of 60 to 100%, preferably 80%, greater than that of the feed roll 92. The yarn bundle is thereby drawn (elongated), preferably by a total factor of about 1.8, reducing the overall yarn titer to form yarn 100. The drawn yarn 100 is preferably treated by a relaxation device 110 to set the draw and to relax the yarn as is conventionally practised in the art. Any known relaxation device may be employed, including steam, heated fluid, hot tube, hot shoe, heated rolls. The relaxed yarn bundle 120 is optionally passed through a second interlace jet 130 and optionally oiled before the relaxed yarn 140 is wound up on a tube 150 at a winding speed greater than 3000 meters per minute, more preferably about 3800 meters per minute. The resulting drawn yarn has an elongation of 25 to 45%, preferably 40 to 45%, and a tenacity of 35 to 45 cN/tex.

Alternatively, referring now to the process schematic in FIG. 5, a partially oriented yarn (POY) is prepared by following path B. The melted polymer 10, a polyamide, is pumped to the spin pack 20 and forced through spinneret plate 30 to form filaments 40. The emerging filaments are cooled by a cross flow of air 50, having an air velocity of about 0.15 to 0.5 meters per minute. The cooled filaments are converged into a yarn 60, and an oil and water finish is preferably applied to the resulting yarn bundle at 70. The yarn 60 is forwarded through a steam atmosphere containing interfloor tube 75, as is known in the art. The steam treated yarn 85 is intermingled at 80 partially wrapped around godet 82 and godet 84, which control any variations in winding tension the yarn may experience. The yarn 115 is wound up as a package of yarn on tube 160 at a speed of about 3800 meters per minute. The POY produced preferably has an elongation of 55 to 85%, preferably 75%, and a tenacity of 25 to 40 cN/tex, preferably about 30 cN/tex.

TEST METHODS

Water Wicking Test Method: The principle of the method involves suspending a strip of fabric vertically with its lower end immersed in water. The height to which the water rises up the fabric in measured at fixed time intervals. The fabric samples taken are 300 mm long and 25 mm wide. The samples are conditioned at a relative humidity of 85%+/−5% and 20° C.+/−2° C. for 16 hours. The maximum rise height of the 20° C.+/−2° C. water is measured after two minutes. The height is measured from the surface of the water to the point on the fabric of maximum water rise. The mean value of three measurements is reported for each perpendicular fabric direction.

Fabric Thickness Test Method: The fabric thickness is the mean distance between upper and lower surfaces of the material measured under a specified pressure. The fabric samples are conditioned as for water wicking. The measuring apparatus used is a Shirley Thickness Gauge with 50 $cm^2$ presser foot. The pressure foot is allowed to fall under its own momentum onto the fabric. The measurement is repeated ten times and the mean and standard deviation are reported to the nearest 0.05 mm.

EXAMPLES

Example 1

Figure 1:
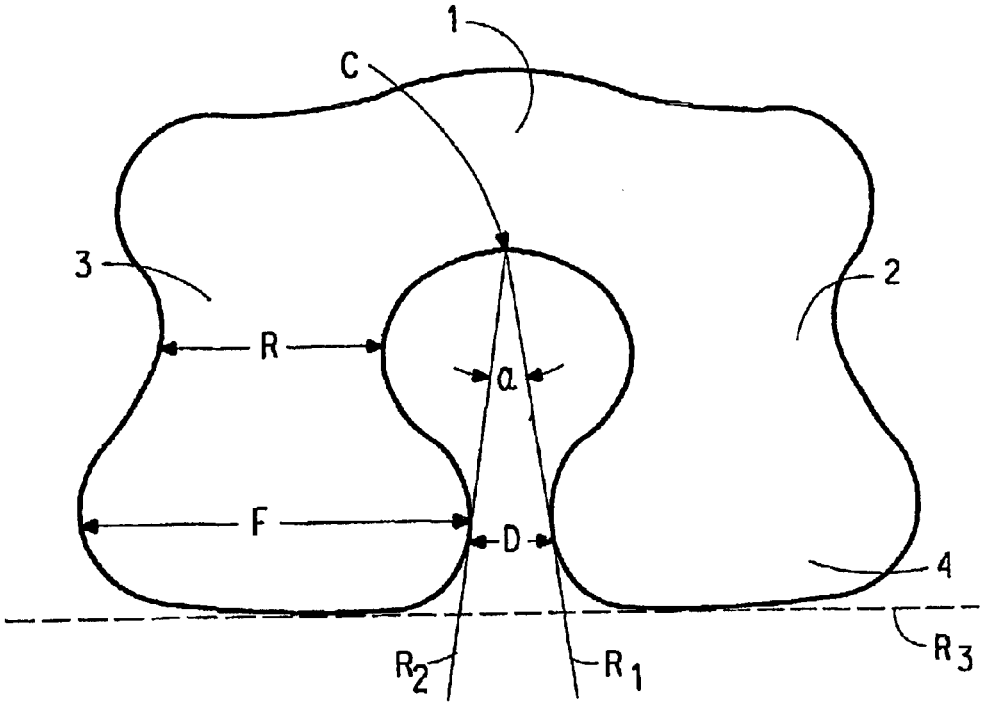
FIG. 1 shows a cross section normal to the longitudinal axis of the filament through one filament with the preferred cross sectional shape showing the dimensions R, F and D, rays $R_1$, $R_2$, reference point C, tangent reference line $R_3$ and the angle alpha ($\alpha$)
Figure 2:
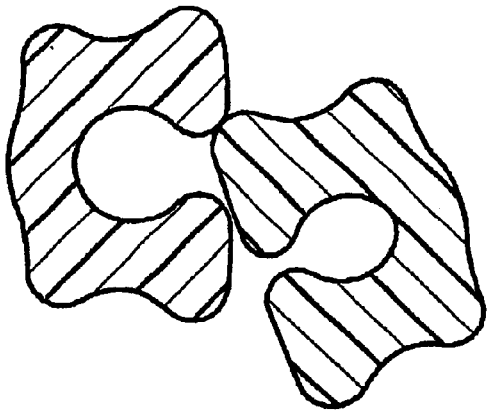
FIG. 2 shows a cross section normal to the longitudinal axis of the filaments through two adjacent filaments according to the invention.
Figure 3A:
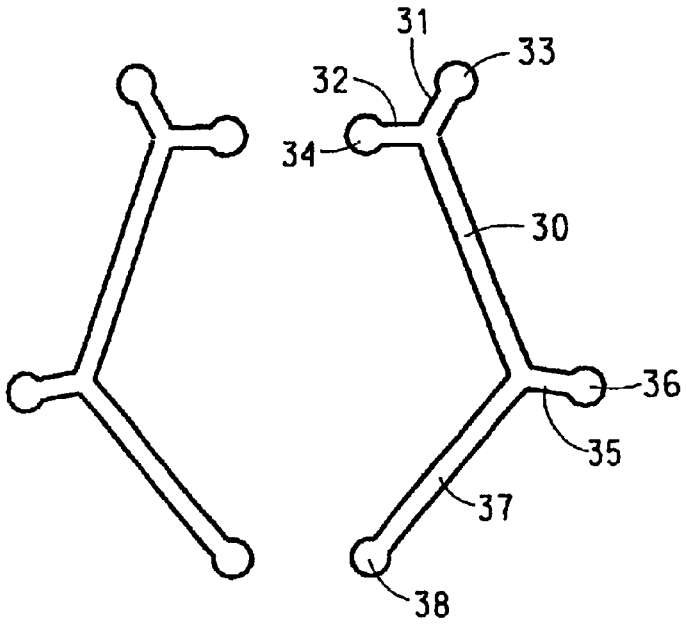
FIG. 3*a* is a plan view (to scale) of a two-segment spinneret capillary cross sectional shape according to the present invention.
Figure 5:
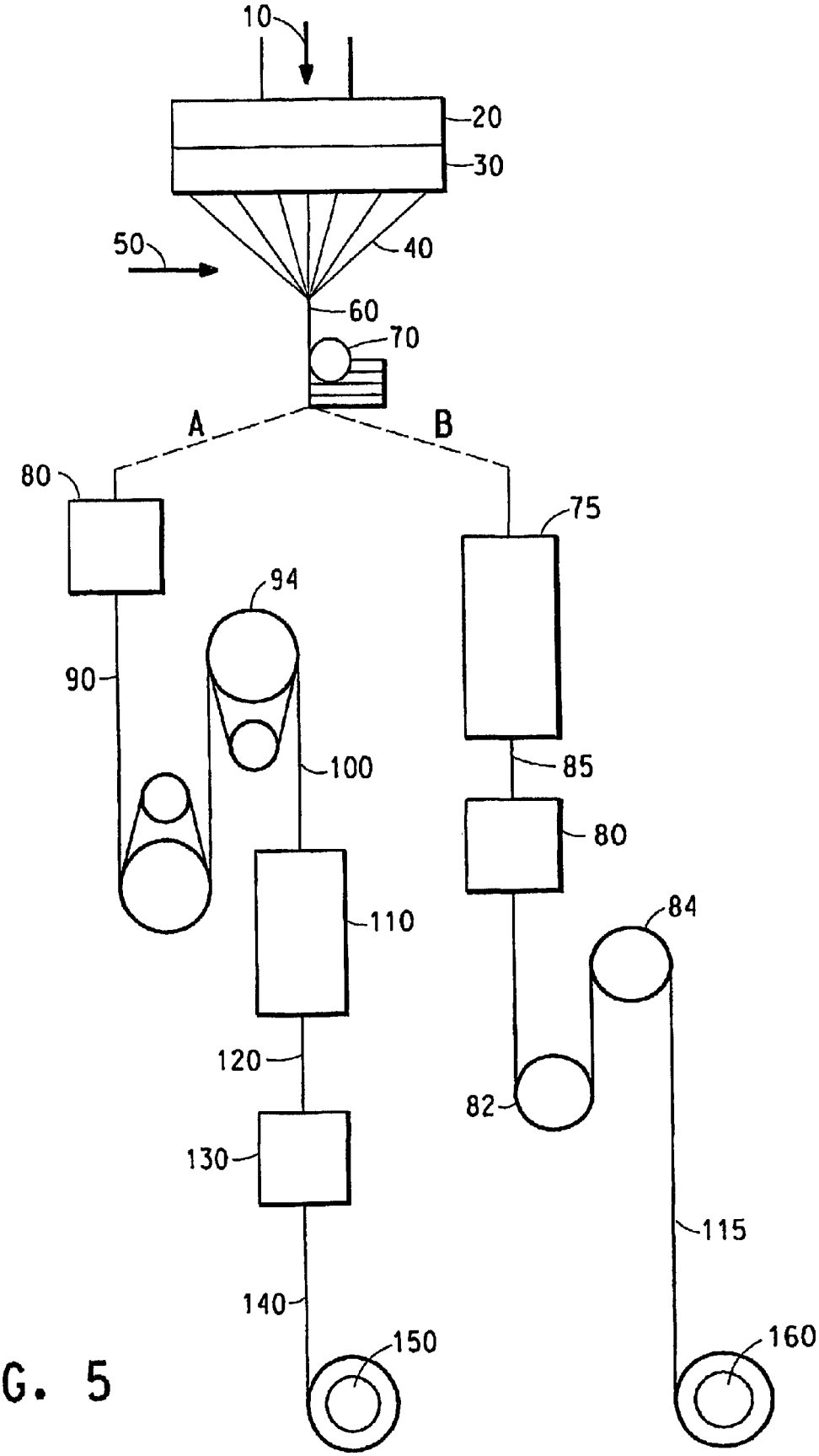
FIG. 5 is a schematic of the apparatus for carrying out the fully drawn yarn (A) and the POY (B) spinning processes according to the present invention.

A first multifilament yarn (Yarn 1A) of 96 dtex and 26 filaments was spun as a POY using the apparatus shown schematically in FIG. 5 and a spinneret plate with two segment capillaries according to FIG. 3*a*.

Nylon 66 polymer chip of 49.4 RV, by the formic acid method, was melted 10 and extruded through a filter pack 20 and through a spinneret plate 30 with 26 capillaries of the segmented cross sectional shape shown in FIG. 3*a* at a spinneret temperature of 280° C.

Next, the emerging filaments 40 were cooled by a cross flow of air 50, with an air velocity of 0.45 meters per minute. The quench air was directed, with reference to FIG. 3*a*, so as to first encounter confronting lobes 38 of the two segment capillary. The cooled filaments 60 were converged into a yarn at 70 where an oil and water finish was applied to the resulting yarn bundle. The converged yarn with the finish applied was forwarded along Path B in FIG. 5. The yarn was passed through a steam atmosphere containing interfloor tube 75. The steam treated yarn 85 was intermingled with apparatus 80. The intermingled yarn 115 was wound up as a package of yarn on tube 160 at a speed of 3800 meters per minute.

Figure 4A:
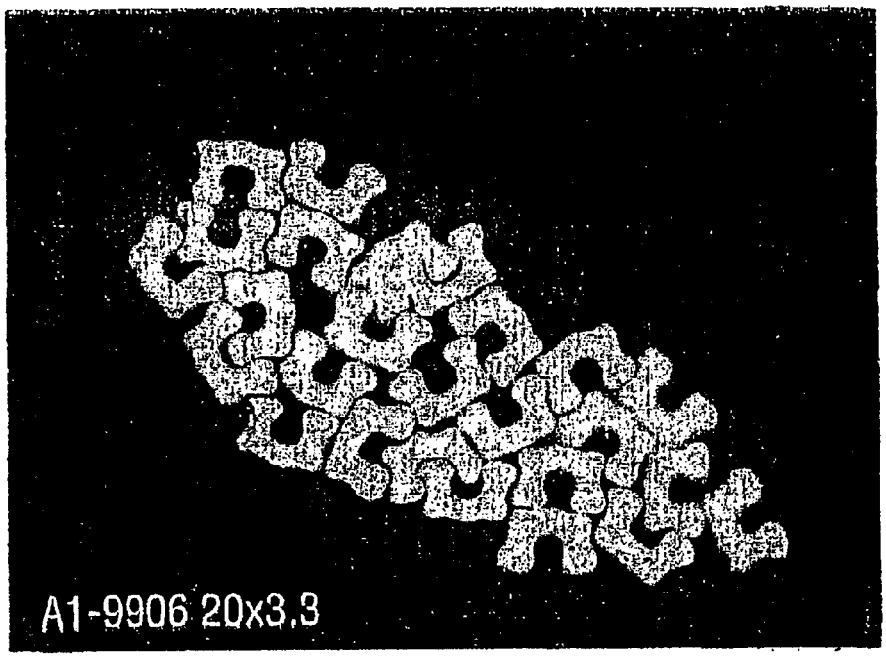
FIG. 4*a* is a yarn bundle photomicrograph of a yarn cross section containing 26 filaments produced by melt spinning in accordance with the present invention from the spinneret capillary cross sectional shape FIG. 3*a*.

The POY produced in this way has a yarn linear density of 96 decitex, an elongation to break of about 75% and a tenacity of 30 cN/tex. The cross section of the yarn is shown in FIG. 4*a*.

Figure 3B:
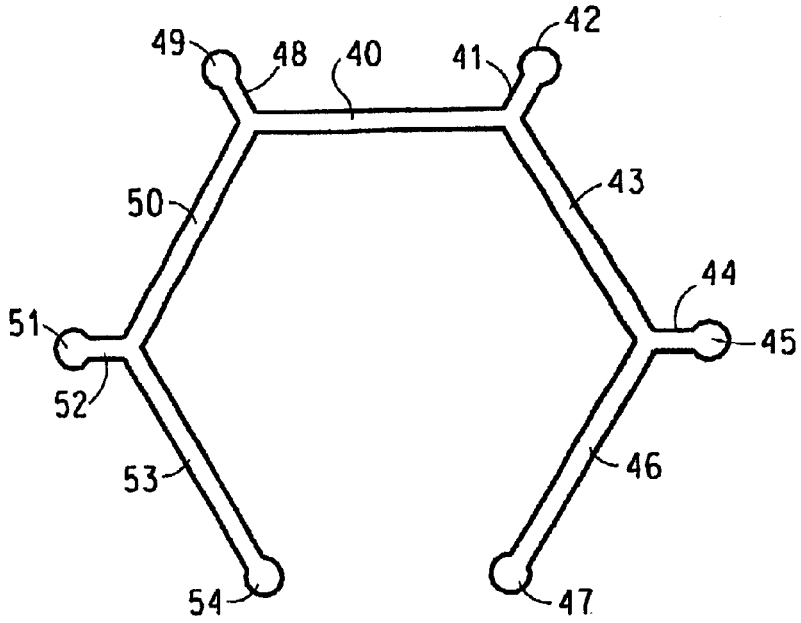
FIG. 3*b* is a plan view (to scale) of a one-segment spinneret capillary cross sectional shape according to the present invention.
Figure 4B:
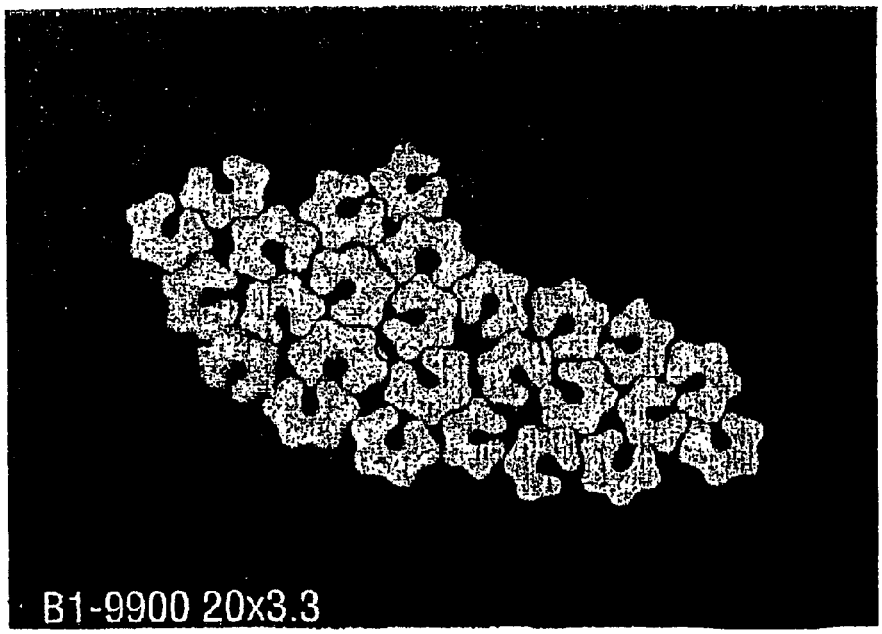
FIG. 4*b* is a yarn bundle photomicrograph of a yarn cross section containing 26 filaments produced by melt spinning in accordance with the present invention from the spinneret capillary cross sectional shape FIG. 3*b*.

A second multifilament partially oriented yarn (Yarn 1B) of 96 dtex and 26 filaments was spun exactly as the first POY using the apparatus shown schematically in FIG. 5. For Yarn 1B a spinneret plate with capillaries according to FIG. 3*b* was used. The elongation and tenacity properties were the same as for the first POY. The cross section of the Yarn 1B is shown in FIG. 4*b*.

A comparative multifilament yarn (Yarn 1C) of 96 dtex and 26 filaments was spun in exactly the same way as the first yarn, except for replacing the spinneret plate with one having 26 "circular cross sectional" shaped capillaries.

All samples, 1A and 1B (yarns of the invention) and 1C (a circular cross section comparative yarn) were separately 8-plied and then air jet textured (AJT) using a HEBERLEIN HEMAJET (Registered Trade Mark) to make a 730 decitex by 208 filament (8×26 filaments) textured yarn. These textured yarns were 2-plied and knitted into a "full cardigan structure" and tested for thermal transmittance.

The thermal transmittance test method was essentially that of ASTM D1518-85 (as reapproved 1990). This method measures the time rate of heat transfer from a warm, dry, constant-temperature, horizontal flat-plate up through a layer of the knitted cardigan test material to a relatively calm, cool atmosphere. Thermal resistance was measured and the thermal insulation or CLO value calculated. The "CLO" is a unit of "clothing thermal resistance" in ASTM D1518 and equal to 0.155(° C. $m^2W^{-1}$). The base temperature was 25° C. ($T_1$) and the head plate, temperature was 35° C. ($T_2$). There was minimal pressure applied to the cardigan knit, 260 $Nm^{-2}$ during the test procedure. Each sample was tested three times to give the mean result reported in Table 1 below.

These test results, reported in Table 1, show a 13–15% increase in thermal resistance for the preferred open hollow cross section versus the circular cross section yarn in a knit construction. Similarly, the CLO values for the open hollow cross section versus the circular cross section yarn in a knit construction increased by 13–15%. Clearly, the open hollow filament yarn in the knit construction tested is a better thermal insulator versus the circular filament yarn.

TABLE 1

| Yarn used in cardigan knit | Thermal resistance Meter$^2$ ° C. $W^{-1}$ × ($10^3$) | CLO value Meter$^2$ ° C. $W^{-1}$/(0.155) ASTM D1518-85 |
|---|---|---|
| Yarn 1A (2 × 730f208) invention cross section using two segment spinneret | 103.7 | 0.67 |
| Yarn 1B (2 × 730f208) invention cross section using one segment spinneret | 105.0 | 0.68 |
| Yarn 1C (2 × 730f208) "circular" cross section | 91.5 | 0.59 |

Example 2

POY samples from Example 1, Yarn 1A and comparative Yarn 1C, both 96 decitex and 26 filaments as spun, were false-twist textured (FTT) at 600 meters per minute on a DCS 1200 texturing machine. The primary heater of the texturing machine was 220° C., no secondary heater was used. A draw-textured yarn of 78 decitex and 26 filaments (78f26) was prepared with the texturing machine's 6 mm solid ceramic discs configured to 1/7/1 smooth/working/smooth. The 78f26 yarns were circular knitted into 28 gauge plain interlock fabrics, scoured, dyed and heat set. Fabric samples of 300 mm by 25 mm were taken for water wicking tests. These samples were hung vertically into a water bath and the vertical rise of the water was measured after two minutes. The mean of three samples is given in Table 2. The fabrics constructed from yarns having filaments of the preferred cross section showed a water wicking advantage over identically constructed fabrics from yarns of circular filament cross section. This advantage is at least a 2-fold improvement in water wicking capability.

TABLE 2

| Textured yarn used in circular knit | Vertical rise in mm (fabric in longest direction) | Vertical rise in mm (fabric in shortest direction) |
|---|---|---|
| 78f26 comparative circular cross section (Yarn 1C) false twist textured yarn | 1.5 | 0 |
| 78f26 invention cross section (Yarn 1A) false twist textured yarn | 3.7 | 2.7 |

Example 3

A drawn yarn of 192 decitex and 52 filaments was spun with the apparatus of FIG. 5 and using the spinneret plate with 52 capillaries of the cross sectional shape of FIG. 3*a*. Nylon 66 polymer of 49.4 RV (by the formic acid method) was melted 10, extruded through a polymer filter pack 20 and then through the above spinneret 30 maintained at a temperature of 280° C. The extruded filaments 40 were cooled by a cross flow of air 50 flowing at 0.4 meters per minute. The cross flow of air 50 was directed to first encounter confronting lobes 38 of the two segment capillary shown in FIG. 3*a*. The cooled filaments were converged into a yarn bundle 60 with oil and water application and forwarded along alternative Path A. The yarn was intermingled with an air jet 80, as typically practised in the art. The intermingled yarn 90 was then fed via feed roll 92 and associated separator roll (making several wraps on the roll to prevent slipping) to a second godet 94 and associated separator roll (the draw roll), moving at a surface speed 80% greater than that of the feed roll 92. The intermingled yarn bundle 90 was drawn, by a total factor of 1.8, reducing the overall yarn titer. The drawn yarn 100 was treated by a steam jet 110 to set the draw and to relax the yarn. The relaxed yarn bundle 120 was passed through a second interlace jet 130 and then the yarn 140 was wound up on a tube 150 at a speed of 3800 meters per minute. This process provided cakes of fully drawn yarn (FDY) with a yarn linear density of 192 decitex, a breaking elongation of 42.8%, tenacity of 41 cN/tex. The yarn in dry form had an RV of 50.3 by the formic acid method. Filaments of this 52 filament yarn have a cross sectional shape normal to the longitudinal axis which is substantially similar to those filaments shown in FIG. 4*a*.

This yarn, Yarn 3A, was used as the weft yarn of a woven fabric of 3/1 twill weave where the warp yarns were 78 decitex (51 circular filaments). Weaving and fabric finishing details are given in Table 3. As a comparative example, a fully drawn yarn of 192 decitex and 52 filaments was spun in exactly the same way as above but using a spinneret plate with "circular cross section" capillaries, this yarn was called Yarn 3B. A second fabric sample was woven using Yarn 3B in the weft as above. Weaving and fabric finishing details are given in Table 3. The two fabrics were finished identically in greige, dyed and heat-set form. From each fabric specimen (greige, dyed and heat-set) 10 samples of 75 square millimeters were cut. These samples were measured for fabric thickness in the same way using a micrometer. The results of the fabric thickness measurements (mean of 10 measurements) are provided in Table 3. The fabrics containing the preferred cross section filaments in the weft were thicker than that woven of entirely circular cross section filaments in the warp and weft. As a result, the woven fabrics having the preferred cross section filaments in the weft provided a lower density fabric with a lightweight aesthetic.

TABLE 3

| | Greige fabric Yarn 3B | Greige fabric Yarn 3A | Dyed fabric Yarn 3B | Dyed fabric Yarn 3A | Heatset fabric Yarn 3B | Heatset fabric Yarn 3A |
|---|---|---|---|---|---|---|
| Warp ends per cm × weft picks per cm | 57.5 × 38.8 | 58.2 × 39.7 | 61.3 × 40 | 62.2 × 39.8 | 61.5 × 41 | 61.6 × 41 |
| Woven fabric thickness millimeters | 0.22 | 0.24 | 0.20 | 0.22 | 0.20 | 0.21 |

The above embodiments have been described by way of example only. Many other embodiments of the filaments, yarns, spinnerets and processes according to the present invention will be apparent to the skilled reader.

What is claimed is:

1. A polymer yarn comprising at least a single profiled filament having an open hollow cross-sectional profile shape normal to the longitudinal axis of the filament, said cross-sectional profile shape having a central arcuate portion and first and second elongated leg portions, each of said leg portions having proximal and distal end portions, said proximal end portions joining to said central portion and said distal end portions joining to foot portions on each leg portion, said foot portions having a dimension F, said leg portions and said central arcuate portion defining an open portion, said leg portions oriented in a substantially parallel relationship, and said foot portions defining an aperture leading to said open portion; said aperture having a dimension D, wherein dimension D is less than dimension F.

2. A polymer yarn according to claim 1, wherein the cross-section comprises a solid part, a central hollow region, and an opening leading into the central hollow region, wherein the opening subtends a radial angle ($\alpha$) of less than 60°.

3. A polymer yarn according to claim 1, wherein the polymer is selected from the group of nylon 66 and nylon 6 and copolymers of nylon 66 or nylon 6, wherein the polymer is a polyamide polymer having a relative viscosity, by a formic acid method, in the range of 40 to 56.

4. A polymer yarn according to claim 1, wherein the profiled single filament linear density is less than 20 dtex and the yarn elongation to break is about 20 to 50% and the tenacity is about 25 to 60 cN/tex.

5. A polymer yarn according to claim 1, wherein the profiled single filament linear density is less than 20 dtex and the yarn elongation to break is about 55 to 85% and the tenacity is about 25 to 40 cN/tex.

6. An article comprising at least a portion of the polymer yarn of claim 4 or claim 5.

7. A multifilament air jet textured yarn produced from said drawn yarn according to claim 4.

8. A multifilament air jet textured yarn produced from said partially oriented yarn according to claim 4.

9. A multifilament false twist textured (FTT) yarn produced from said partially oriented yarn according to claim 5.

10. A polymer yarn according to claim 1, wherein the cross-section comprises a solid part, a central hollow region, and an opening leading into the central hollow region, wherein the opening subtends a radial angle ($\alpha$) of up to 90°.

* * * * *